United States Patent [19]

Sodec et al.

[11] Patent Number: 5,058,490

[45] Date of Patent: Oct. 22, 1991

[54] BOTTOM SOURCE AIR OUTLET

[75] Inventors: Franc Sodec, Wuerselen-Broichweiden; Wolfgang Schweikert, Stolberg, both of Fed. Rep. of Germany

[73] Assignee: H. Krantz GmbH & Co., Aachen, Fed. Rep. of Germany

[21] Appl. No.: 570,145

[22] Filed: Aug. 20, 1990

[30] Foreign Application Priority Data

Aug. 30, 1989 [DE] Fed. Rep. of Germany ..... 3928621

[51] Int. Cl.[5] ..... F24F 13/062

[52] U.S. Cl. ..... 98/40.01; 98/40.22

[58] Field of Search ..... 98/40.01, 40.05, 40.1, 98/40.11, 40.13, 40.15, 40.16, 40.22

[56] References Cited

U.S. PATENT DOCUMENTS

| | | | |
|---|---|---|---|
| 2,791,170 | 5/1957 | Phillips et al. | 98/40.12 |
| 2,822,741 | 2/1958 | Kennedy | 98/40.11 |
| 2,837,990 | 6/1958 | Tutt | 98/40.13 |
| 3,107,597 | 10/1963 | Person | 98/40.13 |

FOREIGN PATENT DOCUMENTS

| | | | |
|---|---|---|---|
| 2503673 | 8/1975 | Fed. Rep. of Germany | 98/40.05 |
| 2804670 | 6/1979 | Fed. Rep. of Germany | 98/40.05 |

*Primary Examiner*—Harold Joyce

*Attorney, Agent, or Firm*—W. G. Fasse

[57] ABSTRACT

Fresh air is supplied into an enclosed space by an air flow radially and substantially without turbulence horizontally over a floor by an air outlet, the outlet openings of which are substantially flush with the floor surface. The air outlet has a cylindrical air guide collar (1) and a concentric insert (7). The air guide collar (1) has a curved collar section (3) merging radially outwardly into a flange (4) which overlaps and bears against the edge of an opening (2) in the floor. The funnel-shaped insert (7) converges from the top to bottom and has an insert flange (8) that extends radially outwardly in the same plane as the collar flange (4). The insert flange (8) narrows an annular flow passage (9) between the air guide collar (1) and the insert (7). The exhaust aperture of the insert (7) can be closed to some extent by a transverse, horizontally arranged deflecting or baffle plate (12).

10 Claims, 3 Drawing Sheets

BOTTOM SOURCE AIR OUTLET

FIELD OF THE INVENTION

The invention relates to a bottom source air outlet with a cylindrical feed pipe that can be coaxially inserted into a circular floor opening. The upper side of the feed pipe is provided with a disk-shaped covering that has axial openings and the lower side of the feed pipe is provided with a pot-shaped floor component that has radial openings.

BACKGROUND INFORMATION

Such bottom source air outlets are generally known and attempt to achieve a means for vertically introducing, with a low impulse, supply air through a floor into a space without turbulence. Depending on the presence of warm upward air current in the space or room, generated by people, lighting equipment, heat radiating devices and sunlight, the cold air that is supplied into the room through such source air outlets rises upwardly from the floor to the ceiling, where it is sucked out. When the rising air current of the room has a velocity of under 0.1 m/s, noticeable drafts are not present. However, effectively avoiding drafts is a problem.

Providing a horizontal air distribution of the air coming from such outlets poses another problem, because conventional air outlets of this type produce no appreciable horizontal penetration of air flows into the room. Therefore, it has been preferable to have linear air outlets that are arranged directly on the floor in front of railings or partitions. Linear air outlets supply the air into a room substantially horizontally at a velocity of about 0.20 m/s. The supply air flow spreads out over the floor and gradually rises upwardly. However, in such linear air outlets, the horizontal penetration of the air flows is still only about 6 meters at the most. Such a penetration range is not adequate to deliver supply air to all areas of wider or larger rooms.

OBJECTS OF THE INVENTION

In view of the foregoing it is the aim of the invention to achieve the following objects singly or in combination:

to construct a bottom source type air outlet that can be arranged at determined air distribution locations or points distributed over the floor area in the manner of known radial air outlets, whereby the present outlets have an enlarged horizontal penetration range for the supply air;

to construct the present air outlets in such a way that a much smaller outlet distribution density, that is fewer outlets per room, can be chosen to still supply the entire room with supply air which is uniformly distributed throughout the room without causing adverse drafts; and to achieve an air distribution favorably comparable to that of linear air outlets, with an air outlet that is substantially flush with the floor, thereby avoiding that the air outlet projects above the floor.

SUMMARY OF THE INVENTION

A bottom source air outlet of the invention has a cylindrical air guide collar with a radially outwardly extending curved collar which merges into a first flange section for resting the outlet against an edge of a floor opening and wherein a funnel-shaped insert formed by a frustum-shaped jacket converging from top to bottom is concentrically arranged inside the air guide collar, whereby an outer side of said insert and the inner side of the air guide collar define an annulus that is narrowed by a radially outwardly extending second flange section of the insert in the same plane as the first flange section of the air guide collar and, wherein an exhaust cross-sectional flow area of the insert can be closed, except for a ring flow passage, by a horizontally arranged deflecting plate, which is preferably adjustable in its vertical position relative to a plane defined by said flanges.

Due to the radially outwardly extending curved air guide collar, that is connected with its cylindrical part to a cylindrical part of a pot-shaped air inlet, and that merges into the first flange section which rests on an edge of the floor opening, and due to the funnel-shaped insert converging downwardly from top to bottom an arranged inside the air guide collar, the insert and the air guide collar together define an annular flow passage which is narrowed at the plane of the first flange section of the air guide collar by the radially outwardly projecting second flange section of the insert. Further, due to the horizontally, concentrically arranged deflecting or baffle plate, the supply air flows radially and without turbulence at a large radius or spacing from the central axis of the outlet, horizontally out over the floor. Only on the basis of the thermal uplift in the room, does the so introduced supply air rise upwardly with substantially reduced air velocities.

Although the bottom source air outlet of the invention lies flush against the surface of the floor, a flow expansion is achieved in the same manner as with a rectangular linear air outlet which normally extends above the floor surface by at least 100 mm. The conventional linear outlet needs to extend above the floor for horizontally blowing the supply air out of one of the lateral perpendicularly extending side walls of the conventional air outlet. Therefore, a conventional linear air outlet must always be arranged in front of a wall or railing, so that it does not impair further usability of the floor surface. Contrary thereto, the present air outlets do not have to project above the floor, yet they achieve a very desirable horizontal air distribution which is a substantial advantage over the prior art.

According to a further embodiment of the invention, the insert in the air guide collar is held by cross-pieces or lands that extend radially across the annulus formed as the above mentioned exhaust cross-sectional flow area so that no additional means are needed to insure a sufficient carrying capacity for the floor in the area of the air outlet.

According to a further embodiment of the invention, the outlet cross-section of the insert can be covered by a perforated plate and/or a lattice or grid structure. Since the baffling and air guide functions are essentially determined by the deflecting or baffle plate, the perforated plate or grid is used to assure that a person can walk over or step on the bottom source air outlet without the danger of stumbling.

According to another feature of the invention, the deflecting or baffle plate is arranged on top of or, preferably, underneath a central area of the outlet flow cross-section that is provided with the perforated plate.

The arrangement of the deflecting plate underneath or below the perforated plate has the advantage that the deflecting plate can be adjusted to and held at various levels vertically below the plane of the perforated plate.

Through the vertical adjustability of the deflecting or baffle plate, according to the invention, the portion of the stream or flow volume that is blown through the perforated plate can be varied, whereby the vertical penetration range of the supply air flow and the velocity of the air flow that passes out and through between radial cross-pieces over the transverse flow area between the insert and the air guide collar, are changed. Especially when large air flow volumes must be supplied, it is preferred to blow a greater portion of the total air volume upwardly through the perforated plate, in order to keep the air velocity of the air flows that are spreading substantially horizontally over the floor, from increasing to an undesirable extent.

The bottom source air outlet of the invention is especially suited to be combined with the known linear source outlets in front of railings or partitions. The room area can then be ventilated up to a distance of 6 m by the air flows from the linear outlets and the remaining area can be ventilated by the bottom source air outlets arranged in a determined distribution of source outlets over the available floor area.

BRIEF DESCRIPTION OF THE DRAWINGS

In order that the invention may be clearly understood it will now be described, by way of example, with reference to the accompanying drawings, wherein:

FIG. 3A shows an air velocity diagram for the position of the baffle plate as shown in FIG. 3;

FIG. 4A shows an air velocity diagram for FIG. 4.

Figure 1:
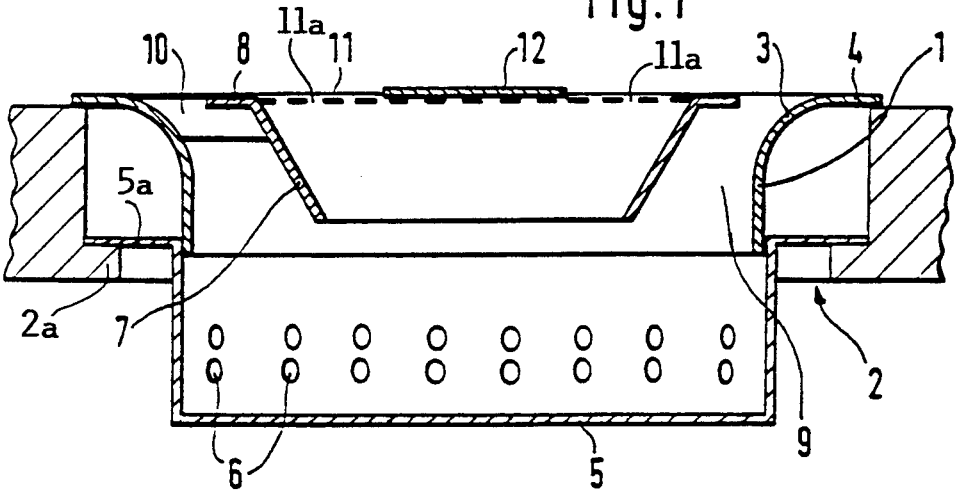
FIG. 1 is a vertical section through a source air outlet of the invention.

DETAILED DESCRIPTION OF PREFERRED EXAMPLE EMBODIMENTS AND OF THE BEST MODE OF THE INVENTION

The present bottom or floor source air outlet comprises a cylindrical air guide collar 1 that is coaxially and vertically insertable into a floor opening 2. A radially outwardly curved collar section 3 merges downwardly into a cylindrical section and radially outwardly into a first flange section 4. When the outlet is installed in the floor opening 2, the first flange section 4 lies against the horizontal edge of the floor opening 2. A recessed ring support surface or shoulder in the floor around the opening 2 permits the upper side or surface of the flange section 4 to extend flush with the upper surface of the floor.

The underside of the air guide collar 1 is connected to a pot-shaped floor air inlet 5 with radial air inlet openings 6 for admitting diffused air, through which the supply air is delivered to the outlet. The floor air inlet 5 has a pot flange 5*a* for resting on a shoulder 2*a* in the floor opening 2. However, this pot flange 5*a* is optional.

A funnel-shaped insert 7 converges from top to bottom or vertically downwardly and is concentrically arranged in the air guide collar 1. The insert 7 has a radially outwardly extending insert second flange second 8 at its upper larger diameter end. The insert flange section 8 lies in the same plane as the air guide collar flange section 4 of the curved collar 3. The inner side of the air guide collar 1 and the outer side of the insert 7 define an annular flow path 9, the cross-sectional flow area of which has a distinct cross-sectional flow area contraction or restriction formed by the insert flange section 8.

Radial cross-pieces or lands 10 are arranged at a uniform distribution around the insert 7 in the annular flow path 9, whereby the insert 7 is fixed stably inside the air guide collar 1.

Figure 2:
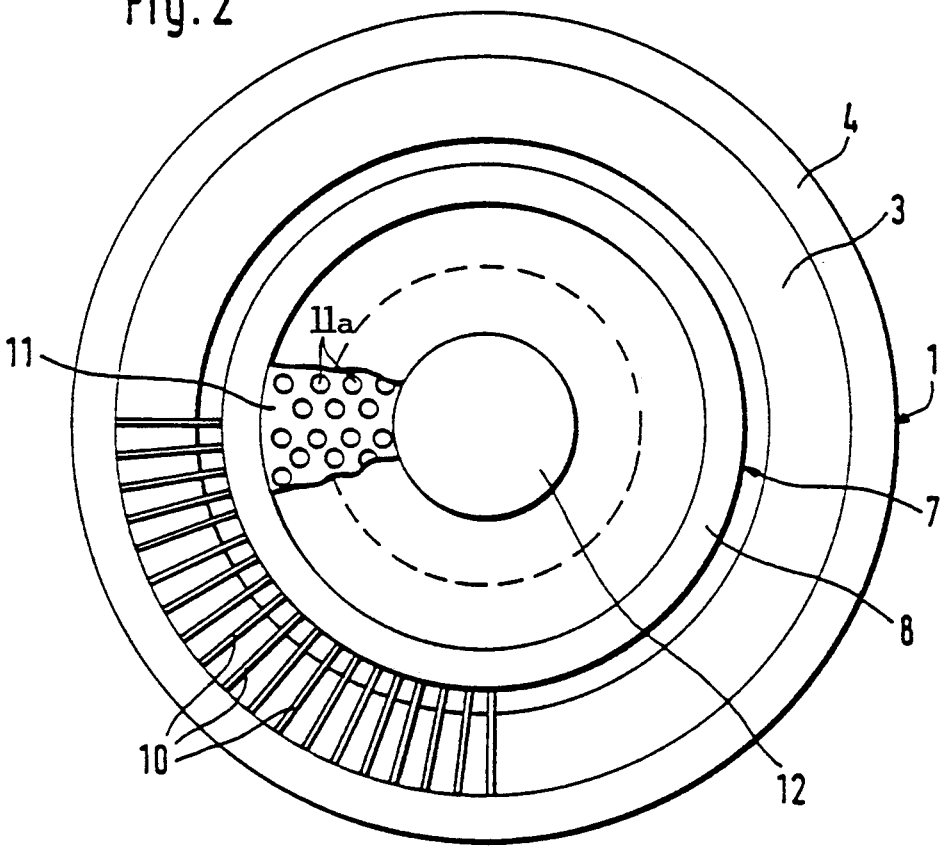
FIG. 2 is a plan view in the direction of the arrow A in FIG. 1.

In the plane defined by the first flange section flange 4 and by the insert second flange section 8, the insert 7 has a perforated plate 11, having perforations 11*a* therein and cooperating with a deflecting or baffle plate 12. In FIGS. 1 and 2, the deflecting or baffle plate 12 is arranged on the perforated plate 11 to close some of the perforations 11*a* in the plate 11.

Figure 3:
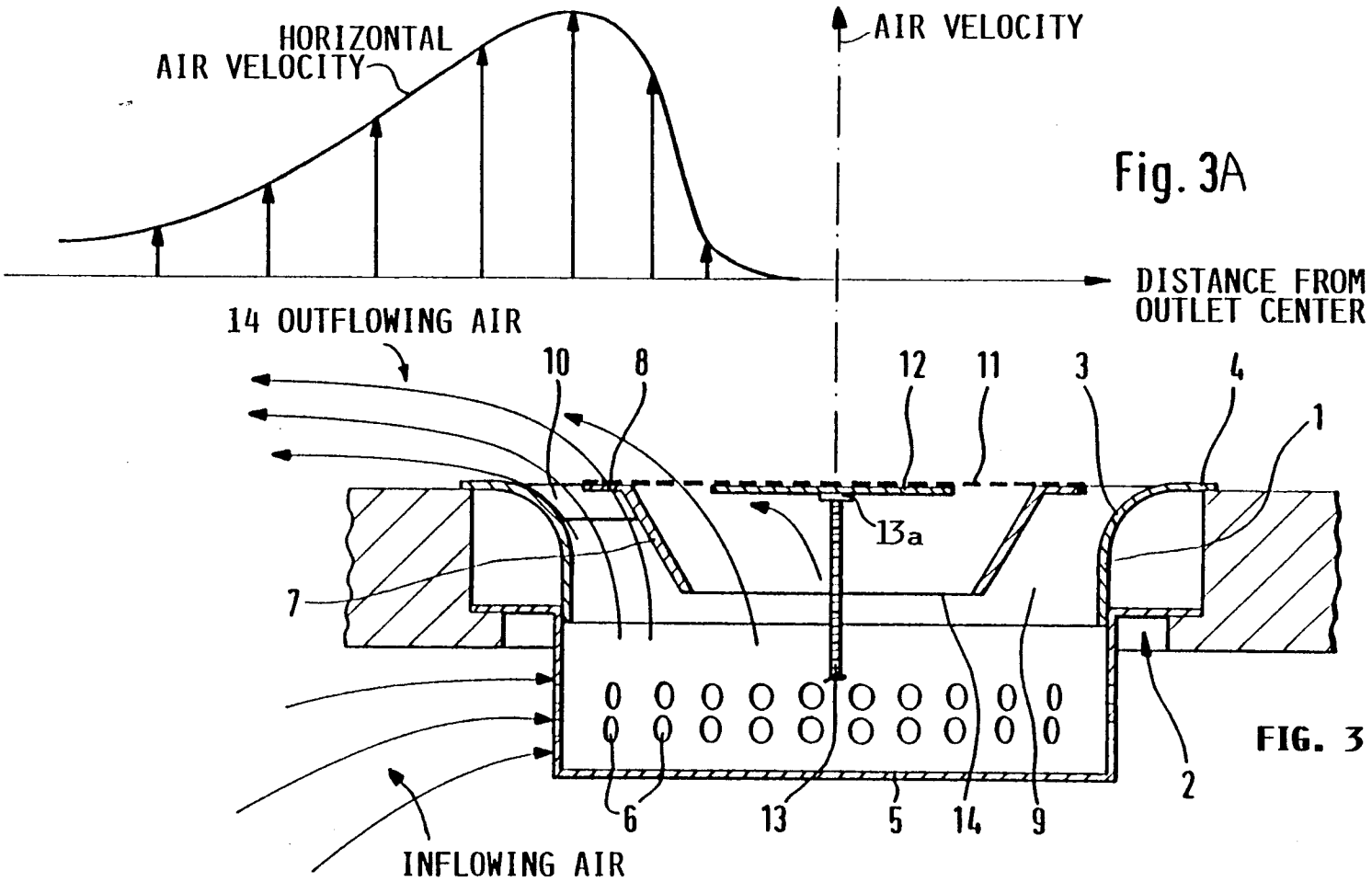
FIG. 3 is a vertical section similar to FIG. 1, showing a deflecting or baffle plate in a position below a perforated outlet plate for large air volumes.
Figure 4:
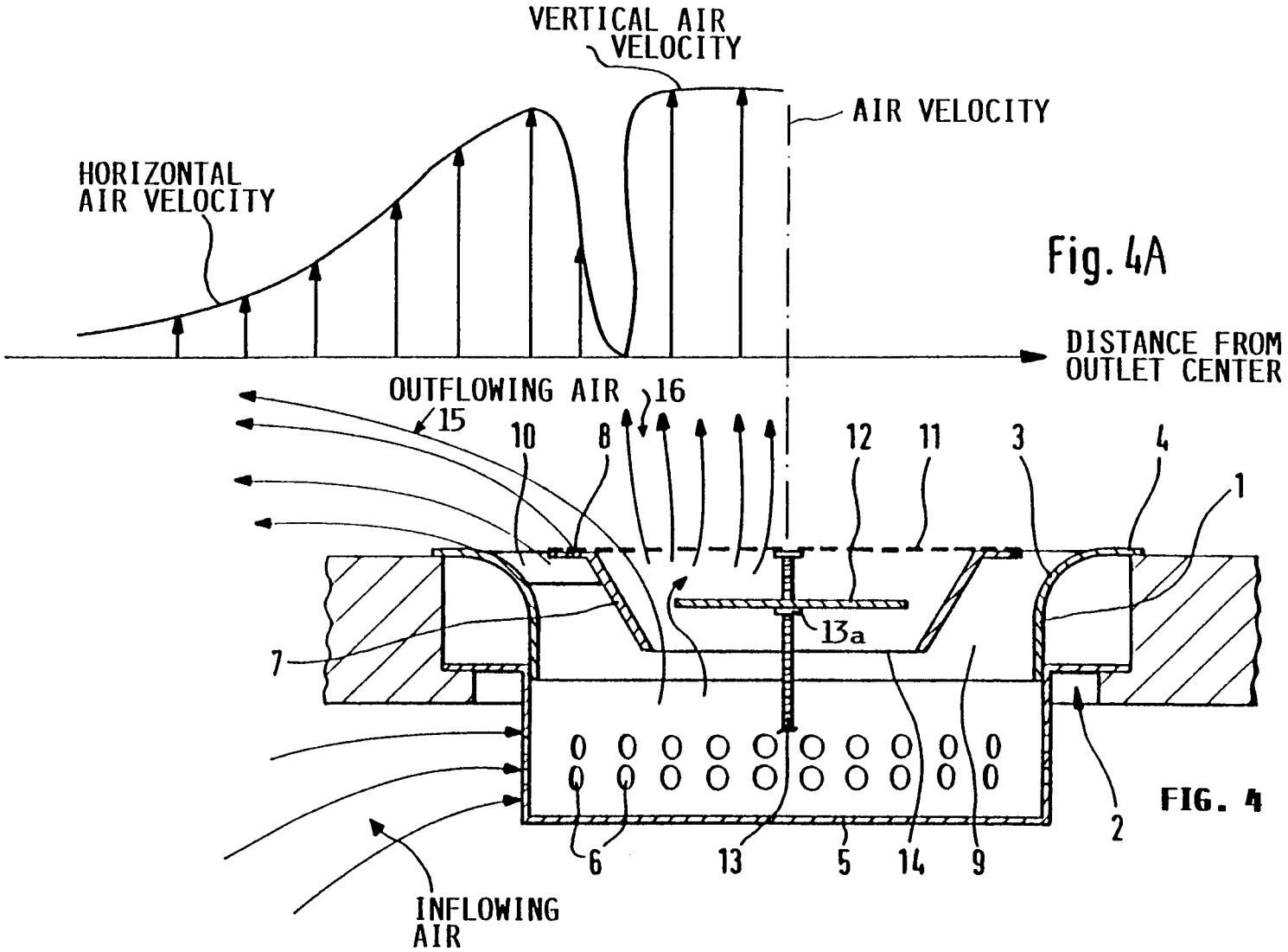
FIG. 4 is a vertical section similar to FIG. 1, showing the deflecting or baffle plate in a position further below the perforated outlet plate for small air volumes.

In FIGS. 3 and 4 the deflecting or baffle plate 12 is arranged underneath the perforated plate 11. For adjustment of the elevation of the baffle plate 12 the latter is movably mounted on a spindle 13 and supported on an adjustable spindle nut 13*a*, whereby the baffle plate 12 may be positioned anywhere along the length of the spindle 13. The spindle 13 is fixed in the insert 7 in a coaxial position.

As can be seen in FIGS. 3 and 4, depending on the position of the deflecting or baffle plate 12, various flow routes for the supply air flows are possible, as shown by the arrows.

FIGS. 3 and 3A show at 14 that with the baffle plate 12 in its topmost position, substantially all of the incoming air flows out in a substantially horizontal direction, whereby the highest air exit velocity is directly at the outlet. FIGS. 4 and 4A show at 15 horizontally outflowing air and at 16 vertically outflowing air. The proportion between the horizontally outflowing air 15 and the vertically outflowing air 16 is adjustable by the position of the baffle plate 12.

Although the invention has been described with reference to specific example embodiments it will be appreciated that it is intended to cover all modifications and equivalents within the scope of the appended claims.

What we claim is:

1. A bottom source air outlet for installation in an opening in a floor, comprising pot-shaped air inlet means with radially facing air inlet holes for introducing diffused air into said outlet, and air guide collar having a cylindrical section connected to said air inlet means, an outwardly curving section and a first flange section, said outwardly curving section connecting said cylindrical section to said first flange section, a funnel-shaped air guide insert converging downwardly and concentrically in said air guide collar, said air guide insert having an upper end second flange section extending radially outwardly toward said first flange section for forming a first annular air flow passage between an outer surface of said air guide insert and an inner surface of said air guide collar, and baffle means operatively arranged inside said air guide insert for closing an upper open end of said air guide insert to form a second annular air flow passage between an inner surface of said air guide insert and a radially outer edge of said baffle means in said air guide insert, and wherein said first flange section of said air guide collar and said second flange section of said air guide insert extend substantially in the same horizontal plane defined by a surface of said floor, so that an outlet plane of said air outlet extends substantially flush with said floor surface, whereby an incoming air volume is divided into a radially outer flow that curves out horizontally over said floor surface and a radially inner flow that is diverted to flow substantially horizontally.

2. The air outlet of claim 1, further comprising radially extending spoke-type lands connecting said air guide insert to said air guide collar, said lands being spaced from one another to form air outlets between neighboring lands in said first annular air flow passage.

3. The air outlet of claim 1, further comprising perforated means for covering said upper open end of said air guide insert.

4. The air outlet of claim 3, wherein said baffle means are arranged on or above said perforated covering means.

5. The air outlet of claim 3, wherein said baffle means are arranged below said perforated covering means.

6. The air outlet of claim 1, further comprising means for adjustably mounting said baffle means for adjusting said baffle means to different elevational positions along a central axis of said air outlet.

7. The air outlet of claim 6, wherein said means for adjustably mounting said baffle means comprise a spindle and a spindle nut.

8. The air outlet of claim 6, further comprising a perforated means secured to said upper open end of said air guide insert, and wherein said baffle means comprise a baffle plate adjustably mounted below said perforated means.

9. The air outlet of claim 1, wherein said outwardly curving section curves radially outwardly from said cylindrical section of said air guide collar into said first flange section for guiding air from an axial direction into a radially outward horizontal direction in cooperation with said radially outer insert second flange section.

10. The air outlet of claim 1, wherein said pot-shaped air inlet means also comprises a radially outwardly extending mounting flange.

* * * * *